US006295674B1

(12) United States Patent
Smith-McKelvey et al.

(10) Patent No.: US 6,295,674 B1
(45) Date of Patent: Oct. 2, 2001

(54) FOLDABLE SLEEPER SOFA MATTRESS AND METHOD OF MANUFACTURING

(75) Inventors: Sharon Lynne Smith-McKelvey, North Myrtle Beach, SC (US); J. Scott Holliday, Roswell, GA (US)

(73) Assignee: Sleeper Solutions, North Myrtle Beach, SC (US)

( * ) Notice: Subject to any disclaimer, the term of this patent is extended or adjusted under 35 U.S.C. 154(b) by 0 days.

(21) Appl. No.: 09/488,545

(22) Filed: Jan. 21, 2000

(51) Int. Cl.[7] ..... A47C 27/15

(52) U.S. Cl. ..... 5/690; 5/659; 5/700; 5/740; 5/722

(58) Field of Search ..... 5/700, 721, 722, 5/727, 739, 740, 12.1, 698, 699, 952, 953, 690, 701

(56) References Cited

U.S. PATENT DOCUMENTS

| | | | | |
|---|---|---|---|---|
| 3,019,456 | | 2/1962 | Kamp . | |
| 3,051,601 | * | 8/1962 | Schick | 5/701 |
| 3,608,106 | | 9/1971 | Parramon . | |
| 3,846,857 | * | 11/1974 | Weinstock | 5/727 |
| 4,035,853 | * | 7/1977 | Platter | 5/722 |
| 4,316,298 | | 2/1982 | Russo et al. . | |
| 4,928,337 | | 5/1990 | Chauncey . | |
| 5,136,741 | | 8/1992 | Balonick et al. . | |
| 5,138,730 | * | 8/1992 | Masuda | 5/701 |
| 5,265,294 | | 11/1993 | McClure et al. . | |
| 5,579,549 | * | 12/1996 | Selman et al. | 5/727 |
| 5,669,094 | | 9/1997 | Swanson . | |
| 5,701,623 | * | 12/1997 | May | 5/739 |
| 5,819,349 | | 10/1998 | Schwartz . | |
| 5,966,759 | | 10/1999 | Sanders et al. . | |

FOREIGN PATENT DOCUMENTS

| | | | |
|---|---|---|---|
| 1 257 962 | 12/1971 | (GB) . | |
| 1 604 401 | 12/1981 | (GB) . | |
| 2187113-A | * 9/1987 | (GB) | 5/952 |
| 2 244 000 | 11/1991 | (GB) . | |

* cited by examiner

*Primary Examiner*—Michael F. Trettel
(74) *Attorney, Agent, or Firm*—Oblon, Spivak, McClelland, Maier & Neustadt, P.C.

(57) ABSTRACT

A foldable springless mattress for a sleeper sofa has a hard but bendable bottom insulator pad, a first flexible foam layer adhered on top of the insulator pad, an all-natural latex rubber layer adhered on top of the first flexible foam layer, and a composite panel adhered on top of the rubber layer. The composite panel includes an intermediate layer of antimicrobial-treated fibers quilted together with a second flexible foam layer and a moisture-resistant damask fabric. This damask fabric covers all surfaces of the mattress. A process of making the foldable springless mattress includes the steps of providing the insulator pad, adhering the first flexible foam layer on top of the pad, adhering the rubber layer on top of the first flexible foam layer, and adhering the composite panel on top of the rubber layer. The composite panel is formed preliminarily by quilting the layer of antimicrobial-treated fibers together with the second flexible foam layer and the damask fabric.

14 Claims, 1 Drawing Sheet

FOLDABLE SLEEPER SOFA MATTRESS AND METHOD OF MANUFACTURING

BACKGROUND OF THE INVENTION

1. Field of the Invention

The present invention relates to beds generally. In particular, the invention relates to a mattress therefor and its method of manufacture.

2. Description of the Related Art

Beds and mattresses have been used for ages, but sleeper sofas with foldable mattresses were developed only in the first half of the twentieth century. Springless sleeper sofa mattresses were first developed by the Englander Co., Inc. of Chicago, Ill., in the late 1950s and are exemplified by U.S. Pat. No. 3,019,456 which was issued to Ewald Kamp on Feb. 6, 1962.

Mattresses made out of multiple layers of different plastic materials were first developed in the late 1960s and were fashionable until about 1990. Such multi-layered plastic mattresses are typified by U.S. Pat. No. 3,608,106 which was issued to Parramon on Sep. 28, 1971, and by U.S. Pat. No. 4,316,298 which was issued to Russo et al. on Feb. 23, 1982. In England, such mattresses are typified by British Patent Specification No. 1,257,962 published on Dec. 22, 1971, and by British Patent Specification No. 1,604,401 published on Dec. 9, 1981.

About 1990, the bedding market began to diversify with a variety of new springless mattresses, such as the following: compactible futons, exemplified by U.S. Pat. No. 4,928,337 issued to Chauncey on May 29, 1990; multiple component mattresses with removable covers, exemplified by U.S. Pat. No. 5,136,741 issued to Balonick et al. on Aug. 11, 1992; mattresses with impermeable PVC coatings, exemplified by U.S. Pat. No. 5,265,294 issued to McClure et al. on Nov. 30, 1993; and mattresses with temperature sensitive top layers, exemplified by U.S. Pat. No. 5,669,094 issued to Swanson on Sep. 23, 1997.

Other springless mattresses of general interest are shown in U.K. Patent Application Ser. No. 2,244,000 published on Nov. 20, 1991; U.S. Pat. No. 5,819,349 granted to Schwartz on Oct. 13, 1998; and U.S. Pat. No. 5,966,759 granted to Sanders et al. on Oct. 19, 1999.

However, it remains a problem in the prior art to make a springless foldable mattress which provides a comfortable night of sleep on a sofa bed.

SUMMARY OF THE INVENTION

A primary object of the present invention is to provide a combination of multiple layers selected and laminated together to produce superior comfortable mattress, unlike any prior art product, for a sofa bed.

A preferred embodiment of the present inventive mattress includes a top layer of an antimicrobial synthetic polyester textile fiber such as DACRON®, a polyurethane quilting foam layer, a natural latex rubber layer, a flexible polyurethane foam layer, and a bottom insulator pad. All layers are bonded with an adhesive to increase durability and all exterior surfaces are covered with a moisture-resistant damask fabric.

A preferred embodiment of the present inventive process is a multi-layered lamination method. Starting with the bottom layer, an insulator pad is laminated to the bottom of the flexible polyurethane foam layer. This insulator pad adds extra cushioning to the bottom to protect a sleeper against feeling any metal support bars in all bed frames that actually hold the mattress. The layer of flexible polyurethane foam varies in thickness to allow a thinner mattress to be accommodated inside current styles of interior frame cavities of sofa beds or to be accommodated inside future styles of interior frame cavities that may house a thicker and plusher mattress for a sofa bed. The flexible polyurethane foam layer is then laminated to a 100% pure latex rubber layer which gives extra support and longevity to the mattress. This rubber layer is believed to outperform any competing type of foam product for a mattress, thus allowing the mattress to hold its shape and to permit a comfortable night's sleep, even for heavy adults. The product resulting from the present inventive method performed well in tests conducted by constantly opening, unfolding and closing the mattress inside the cavity of the sleeper sofa.

The damask fabric covering the complete exterior of the mattress is either polyester or polypropylene or a combination of both. DACRON® is a synthetic polyester textile fiber which may be mixed with silk and blended wool fibers that are bonded together and are sprayed with an EPA-approved antimicrobial agent. This mixture gives the mattress a nicely quilted top for an additional layer of comfort. Also, the moisture-resistant damask fabric helps to protect the inside of the mattress from most kinds of liquids that may be spilled thereon.

The layers are then bound together with binding tape. Subsequently, the top and bottom sides of the mattress are given straps near each corner to allow the mattress to be tied down to the metal support frame. As a result, the mattress is kept from sliding and shifting during the steps of opening and closing the cavity inside the sofa bed. Likewise, the tie-down straps allow the mattress to be retained on the frame when a user sleeps thereon.

A more complete appreciation of the invention and many of the attendant advantages thereof will be readily recognized as the invention becomes better understood by reference to the following detailed description when considered with the accompanying drawing.

DETAILED DESCRIPTION OF THE INVENTION

Figure 1:
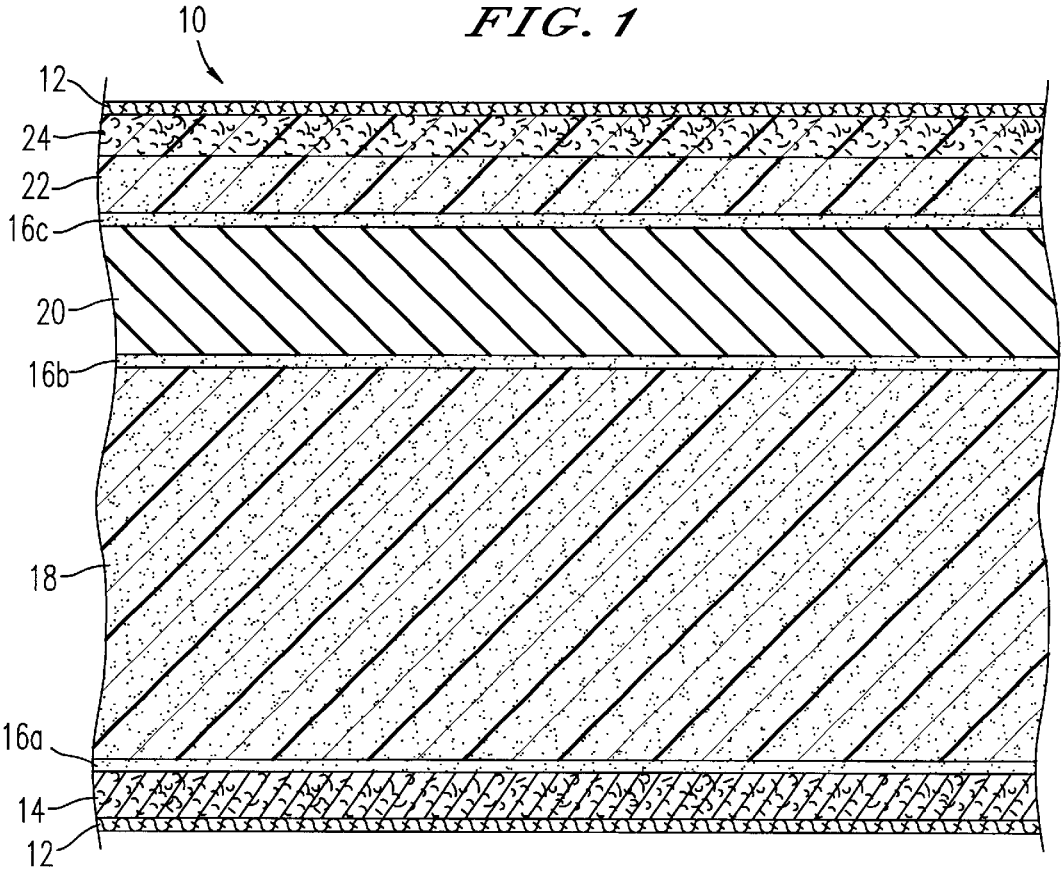
FIG. 1 is a partial cross-sectional view of the mattress of the present invention.

Referring now to the drawing, like reference numerals designate identical or corresponding parts throughout the several figures. In FIG. 1, a partial cross-sectional view of a mattress 10 is shown. The mattress 10 has all surfaces covered with a moisture-resistant damask fabric 12. At the bottom of the internal structure of the mattress 10, there is a hard but bendable insulator pad 14, approximately one-quarter inch thick. This insulator pad 14 is made of either rag fibers, coconut fibers or 100% polyester fibers mixed with adhesive. The insulator pad 14 helps to prevent a sleeper from feeling a metal frame underlying the mattress 10. On top of the pad 14, a thick layer of adhesive 16*a* is applied.

A first layer of flexible polyurethane foam 18 is laid on top of the adhesive 16*a*. The first layer of flexible foam 18 may vary in thickness from two inches to three and one-half inches. Next, a thick layer of adhesive 16*b* is applied on top of the flexible foam 18. A one-inch layer of all-natural latex rubber 20 is then laid on top of the adhesive 16*b*. A third thin layer of adhesive 16*c* is applied on top of the layer of rubber 20. The three layers of adhesives 16*a*, 16*b* and 16*c* may be the same or different types of glue-like materials, as long as they are capable of permanently adhering foam to rubber. A second layer of flexible polyurethane foam 22 is then quilted inside the damask fabric 12 together with an intermediate lining of antimicrobial-treated fibers 24 which may be 80% DACRON® fibers, 10% silk and 10% blended wool. The second layer of foam 22 is about a half-inch thick. The quilted combination of the damask fabric 12, the antimicrobial-treated fibers 24 and the polyurethane foam 22 form the top layer which is adhered by the adhesive 16*c* on top of the layer of rubber 20. All four sides, as well as the top and bottom of the mattress 10, are then secured together with binding tape. Finally, four tie-on straps (not shown) are sewn to the four comers of the mattress 10.

Figure 2:
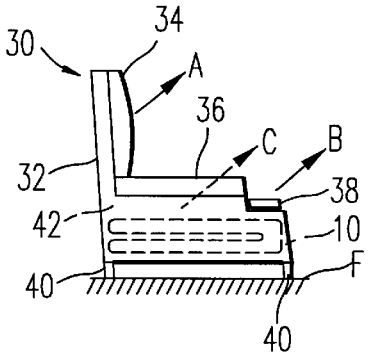
FIG. 2 is a side elevational view of the sleeper sofa with the mattress folded and closed inside the cavity.
Figure 3:
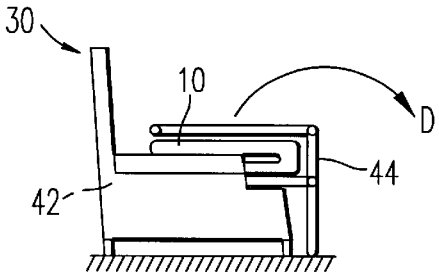
FIG. 3 is a side elevational view of the sleeper sofa with the mattress pulled outside of the cavity but still remaining in its folded condition.
Figure 4:
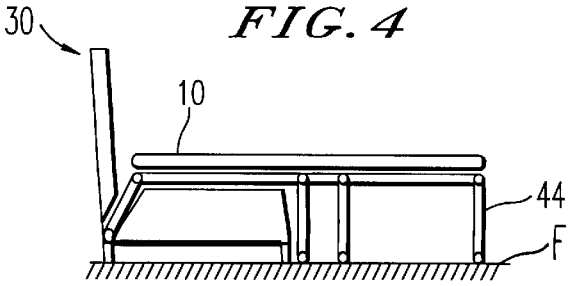
FIG. 4 is a partially broken away, side elevational view of the sleeper sofa with the mattress in its completely unfolded condition outside the cavity.

FIGS. 2–4 show the use of the mattress 10 in a sleeper sofa 30. In FIG. 2, the mattress 10 is seen in its folded condition inside the sofa 30. The sofa 30 is conventional in that it has a rear 32, a back rest 34 which is removable in a direction A, an arm rest 36, a seat cushion 38 which is only partially shown but which is removable in a direction B, and a plurality of legs 40 which rest on a floor F. When not in use, the mattress 10 is stored in a cavity 42 inside the sofa 30, but is removable therefrom in a direction C.

FIG. 3 shows the sofa 30 in the process of being converted into a bed. After the back rest 34 is removed in the direction A and the seat cushion 38 is removed in the direction B, as previously seen in FIG., 2, a hinged metal frame 44 is pulled out of the cavity 42 and is unfolded in a direction D.

FIG. 4 shows the sofa 30 with the metal frame 44 completely laid out and the mattress 10 in its unfolded condition to form a bed ready for use by a sleeper. Note that the mattress 10 itself is springless. The details of the process of removing the metal frame 44 from the sofa 30 and the steps of setting up the frame 44 on the floor F are not discussed, although they are shown in the drawings, because they are conventional.

Of course, other modifications and variations of the present invention are possible in light of the above teachings.

What is claimed as new and is desired to be protected by Letters Patent of the United States is:

1. A foldable mattress for a sleeper sofa, comprising:

a. a hard but bendable bottom insulator pad;

b. a first flexible foam layer adhered on top of the bottom insulator pad;

c. an all-natural latex rubber layer adhered on top of the first flexible foam layer; and d. a composite panel adhered on top of the rubber layer.

2. A foldable mattress, according to claim 1, wherein the mattress is springless.

3. A foldable mattress, according to claim 1, wherein the bottom insulator pad is manufactured from fibers mixed with adhesive.

4. A foldable mattress, according to claim 1, wherein the composite panel includes a top moisture-resistant damask fabric, a second flexible foam layer, and an intermediate layer of antimicrobial-treated fibers, all being quilted together.

5. A foldable mattress, according to claim 4, wherein the damask fabric covers all surfaces of the mattress.

6. A foldable mattress, according to claim 4, wherein the intermediate layer of antimicrobial-treated fibers includes synthetic polyester textile fibers.

7. A foldable mattress, according to claim 2, wherein the intermediate layer of antimicrobial-treated fibers is composed of 80% synthetic polyester textile fibers, 10% silk and 10% blended wool.

8. A process of making a foldable mattress for a sleeper sofa, comprising the steps of:

a. providing a hard but bendable bottom insulator pad;

b. adhering a first flexible foam layer on top of the insulator pad;

c. adhering an all-natural latex rubber layer on top of the first flexible foam layer; and d. adhering a composite panel on top of the rubber layer.

9. A process, according to claim 8, wherein the mattress in springless.

10. A process, according to claim 8, further comprising the step of manufacturing the bottom insulator pad from fibers mixed with adhesive.

11. A process, according to claim 8, further comprising the step of:

e. forming preliminarily the composite panel by quilting together a top moisture-resistant damask fabric, a second flexible foam layer, and an intermediate layer of antimicrobial-treated fibers.

12. A process, according to claim 11, further comprising the step of:

f. covering all surfaces of the mattress with the moisture-resistant damask fabric.

13. A process, according to claim 11, wherein the intermediate layer of antimicrobial-treated fibers includes synthetic polyester textile fibers.

14. A process, according to claim 11, wherein the intermediate layer of antimicrobial-treated fibers is 80% synthetic polyester textile fibers, 10% silk and 10% blended wool.

* * * * *